US007488048B2

(12) United States Patent
Paganini

(10) Patent No.: US 7,488,048 B2
(45) Date of Patent: Feb. 10, 2009

(54) MOBILE DISPLAY UNIT FOR STREET TRADERS

(76) Inventor: Luca Paganini, Via Trieste, 17, I-46034, Governolo di Roncoferraro (IT)

( * ) Notice: Subject to any disclaimer, the term of this patent is extended or adjusted under 35 U.S.C. 154(b) by 376 days.

(21) Appl. No.: 10/487,771

(22) PCT Filed: Aug. 27, 2002

(86) PCT No.: PCT/IT02/00551

§ 371 (c)(1),
(2), (4) Date: Aug. 30, 2004

(87) PCT Pub. No.: WO03/017806

PCT Pub. Date: Mar. 6, 2003

(65) Prior Publication Data

US 2005/0017480 A1 Jan. 27, 2005

(30) Foreign Application Priority Data

Aug. 27, 2001 (IT) ..... MN2001A0037

(51) Int. Cl.
*A47B 46/00* (2006.01)

(52) U.S. Cl. ..... 312/249.11; 312/198; 312/298

(58) Field of Classification Search ..... 312/294, 312/298, 302, 318, 303, 249.8, 249.11, 24, 312/27, 240, 198, 201, 205, 330.1, 317.1, 312/247, 312, 301; 108/145, 16; 280/47.34, 280/47.35, 79.11, 79.3
See application file for complete search history.

(56) References Cited

U.S. PATENT DOCUMENTS

| | | | | | |
|---|---|---|---|---|---|
| 926,946 | A | * | 7/1909 | Klug | 312/271 |
| 1,494,168 | A | * | 5/1924 | Hughes | 312/25 |
| 1,621,324 | A | * | 3/1927 | Hughes | 312/27 |
| 2,634,186 | A | * | 4/1953 | Zuss | 312/201 |
| 2,881,865 | A | * | 4/1959 | Lewis | 187/231 |
| 2,927,696 | A | * | 3/1960 | Michaels et al. | 211/27 |
| 5,586,816 | A | * | 12/1996 | Geiss, II | 312/301 |
| 5,823,368 | A | * | 10/1998 | Burke et al. | 211/175 |
| 6,076,621 | A | * | 6/2000 | Horn | 180/19.2 |

* cited by examiner

*Primary Examiner*—Janet M Wilkens
(74) *Attorney, Agent, or Firm*—Thomas R. Vigil

(57) ABSTRACT

A mobile display unit (1) for street traders is described, which is particularly recommended to contain, conserve, transport and display goods, i.e. objects or foodstuffs in travelling markets. The mobile unit (1) is formed by a structure composed of a base frame (2*a*) from which uprights (2*b*) are detached to which a second frame (2*c*) is attached that forms the upper surface and a third frame (2*d*) placed between the other two frames (2*a*, 2*c*). The structure accommodates at least one pair of warehouse cases (7, 8) or sliding containers on guides, placed one above the other in the rest mode and side by side in the operative mode.

6 Claims, 7 Drawing Sheets

MOBILE DISPLAY UNIT FOR STREET TRADERS

TECHNICAL FIELD

The present invention relates to a mobile display unit for street traders, particularly recommended to contain, store, transport and display goods in travelling markets.

BACKGROUND ART

As is widely known, currently, in retail to present goods on sale to the public, street traders use wooden or metal work surfaces on which the sale goods are displayed. The said structures have many drawbacks: each time the street trader has to set up the work surface, he has to arrange the goods on arrival at the market and replace them into boxes and the lorry at the end of the working day. Besides, the spare stock remains in the lorry and is out of easy reach. In addition to the aforementioned, the presence of at least two operators is frequently required to set up and replace all the goods with considerable loss of time on each occasion, particularly if the objects to handle and set up are very small, and the repetition of such operations entails the wear and tear of the coverings and causes fingermarks which ruin the aesthetic appearance of the objects and packaging.

Currently, to overcome the drawbacks illustrated above, on the market there are mobile display units illustrated in the patent for industrial invention U.S. Pat. No. 1,287,735 by the same Applicant which overcome the aforementioned problems.

In fact, the mobile units described in the U.S. Pat. No. 1,287,735 allow the goods on sale to always be contained tidily and permanently displayed using containers acting as a warehouse, thus completely avoiding the set-up and display demobilization time. In particular, the mobile units illustrated in the said patent are essentially composed of a support casing which includes a first quadrangular frame that forms the perimeter of a base surface from which four vertical uprights are detached which engage a second frame that forms the perimeter of a first display surface.

Besides, the said casing us fitted with four mobile uprights mounted on the first frame and engaging to a third frame that forms the perimeter of a second display surface. In greater detail, the first and second display surfaces are made of polyvinylchloride, which also proves to be easy to clean and, when the mobile unit is in operative mode, create a single and practical display surface to exhibit the goods, while on the base surface one or more sliding warehouse cases are housed to contain the spare stock at the disposal of the street trader.

The mobile unit is designed to pass from a resting condition, that is, closed, when it is transported, with the second display surface placed above the first surface, to an operative mode, that is, open, with the first and second surfaces placed side by side, thus creating a single horizontal surface.

The second surface, in operative mode, is supported by two support elements that form two legs and prevent it from tipping over, and by the support of the mobile upright against a stopping element present on the support casing.

From the said mobile unit, even though it overcomes the known technical problems previously illustrated, other technical problems have arisen. The first problem derives from the fact that the mobile units illustrated in the patent are recommended for containing different types of objects but are not suitable for containing, for example, foodstuffs. In fact, for the correct storage of foodstuffs, closed containers are necessary to avoid contact with the public, insects, dust and other items which would cause their deterioration, as well as the fact that certain temperatures are required for their correct conservation.

Another problem found in the sale of foodstuffs in travelling markets derives from the fact that the vans currently used are specially designed for the transport and storage of foodstuffs but such preparations involve considerable costs.

Another problem encountered emerges from the fact that, at times, the objects contained are heavy, so the street trader must exert a certain physical effort to put the mobile unit into operative mode, that is, when he has to rotate the second surface display, lowering the third frame until the two support elements touch the ground and the two surfaces are placed side by side.

Besides, the mobile units are currently of a height that does not conform to the regulations that require a maximum height of 100 cm for the sale of foodstuffs.

Finally, the said mobile units, even though allowing good display of the goods on sale, do not allow good arrangement, for example, of shoes that need a sloping surface for their optimum presentation to the public.

DISCLOSURE OF INVENTION

The aim of the present invention is essentially to resolve the said technical problems overcoming the aforementioned drawbacks by means of a mobile display unit for street traders, capable of containing, storing and displaying sales goods in a permanent way.

A second aim of the present invention is to produce a mobile display unit that is capable of containing foodstuffs, maintaining them at the required temperatures for their correct conservation both during display periods and transport.

A third aim of the present invention is to realize a mobile display unit that includes, incorporated into the structure, a refrigerated area for the conservation of foodstuffs.

Another aim of the present invention is to produce a mobile display unit that is easy to use, has simple manoeuvrability and considerable containing capacity and can offer easy set-up and practical, fast opening and closing without requiring particular effort for preparation.

A further aim of the present invention is that of producing a mobile display unit which does not require physical exertion for its opening and closing, which would simply need following through in its movement by the operator.

A further aim of this invention is to realize a mobile display unit that can present a considerable display surface.

The last but not least aim of the present invention is to realize a mobile display unit which is simple to produce and with good functionality. These and further aims, that will better emerge in the description that follows, are essentially atteined by a mobile display unit for street traders, according to the claims illustrated hereunder.

Further characteristics and advantages of the present invention will better emerge from the detailed description that follows, made with reference to the attached diagrams, of a non limiting example of a mobile display unit for street traders, object of the present invention, in which:

FIG. 14 shows in lateral view another variation of the mobile unit according to this invention in closed mode;

With reference to the said figure, 1 indicates a mobile unit display for street traders on the whole, according to the present invention.

Mobile unit 1 is composed of a structure 2, produced in aluminium or stainless steel sections attached to each other by means of joints in molten aluminum and essentially composed of a base frame 2*a* from which a plurality of irremovable and vertically placed uprights 2*b* are detached at the upper ends of which a second frame 2*c* is present which forms an upper surface of the mobile unit 1. Besides, structure 2 includes a first pair of horizontal struts 3*a* placed at approximately a third of the height of the uprights 2*b* and a second pair of horizontal struts 3*b* placed higher than the first pair and at a prearranged distance from the second frame 2*c* whose function will be illustrated later. Besides, structure 2, between the two pairs of horizontal struts 3*a* and 3*b*, includes a third frame 2*d*.

Figure 1:
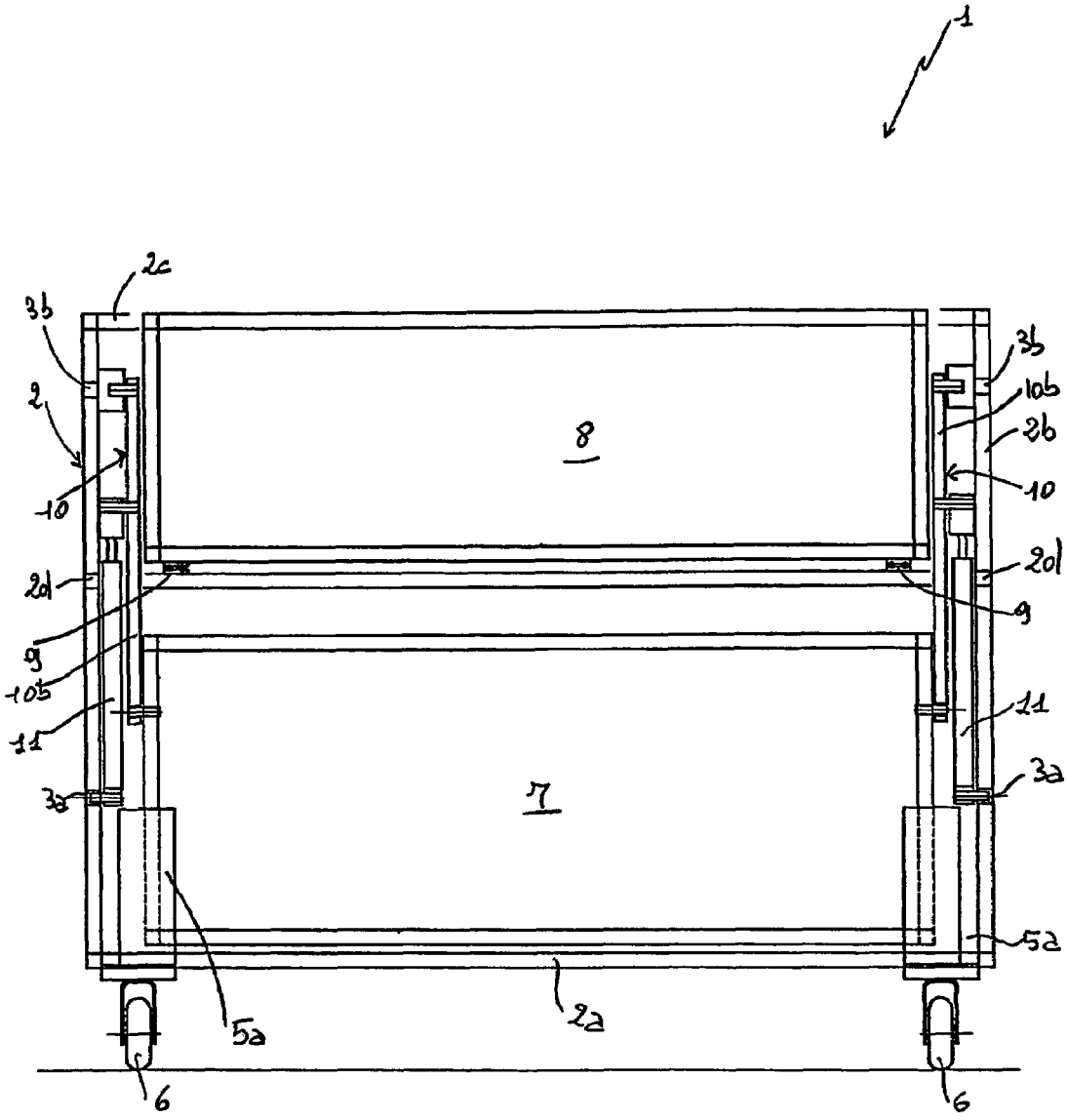
FIG. 1 shows, schematically and in frontal view, a mobile display unit relating to the present invention.
Figure 4:
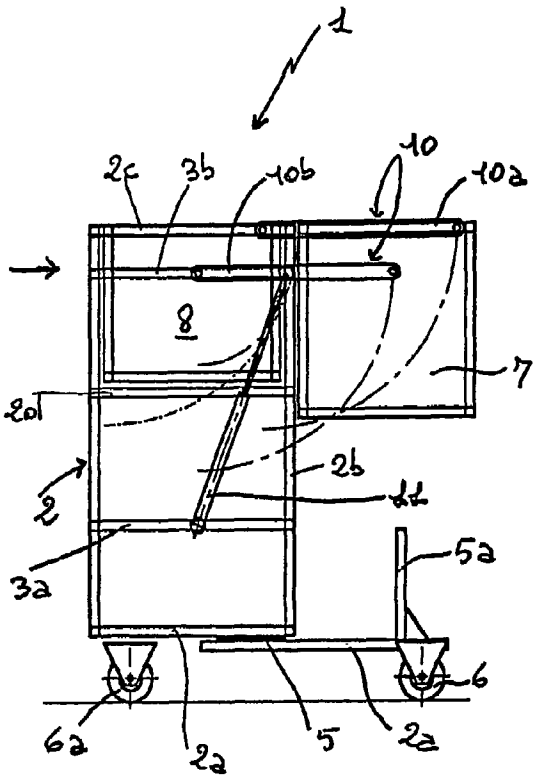
FIG. 4 shows again in lateral view the mobile unit from FIG. 1 in open mode.
Figure 3:
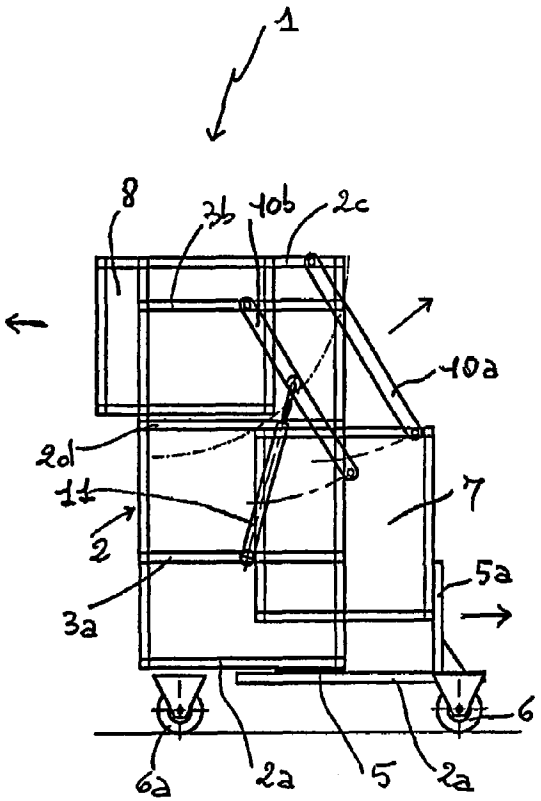
FIG. 3 shows lateral view of the mobile unit in semi-open mode.

In particular, a pair of linear guides 5 is engaged to the base frame 2*a* which make the frame telescopic. Two stabilising wheels 6 are fixed to the frame 2*a*, in the telescopic portion, while two other wheels 6*a* are mounted on the frame in the fixed portion, as shown in FIGS. 3 and 4.

Besides, the base frame 2*a* is devised to hold at least one lower warehouse case 7.

In accordance with the present embodiment, mobile unit 1 is provided with at least one second large warehouse case 8 capable of sliding on guides 9 mounted on the third frame 2*d* and placed above the warehouse case 7.

Moreover, structure 2 includes, on each side, a pair of connecting rods 10 supplied for the movement of the lower warehouse case 7. Each pair of connecting rods 10 is composed of a first connecting rod 10*a* mounted with one end to the second frame 2*c* and with the other end to the upper edge of the warehouse case 7 and of a second connecting rod 10*b* mounted respectively with one end to the second horizontal struts 3*b* and with the other end to a prearranged point of the lateral wall of the warehouse case 7. In particular, on each second connecting rod 10*b*, essentially in correspondence with its centre line, is mounted one end of an actuating means 11 the other end of which is instead fixed to the first horizontal strut 3*a*. The actuating means 11 is composed of gas springs or of electrical, pneumatic or hydraulic actuators.

Figure 2:
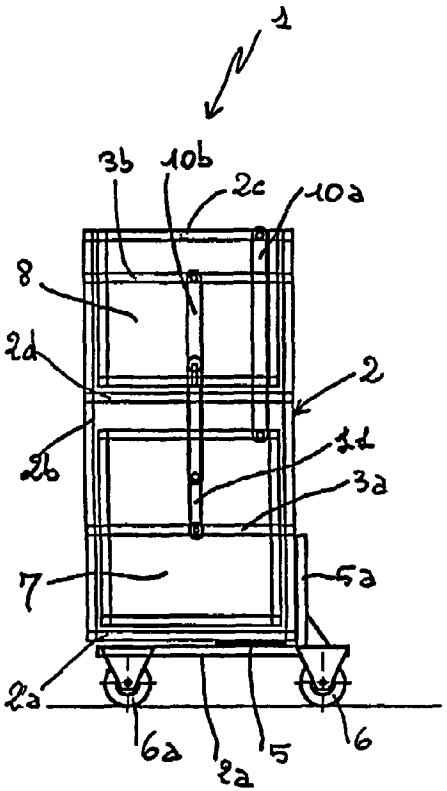
FIG. 2 shows the mobile unit from FIG. 1 in lateral view in closed mode.
Figure 5:
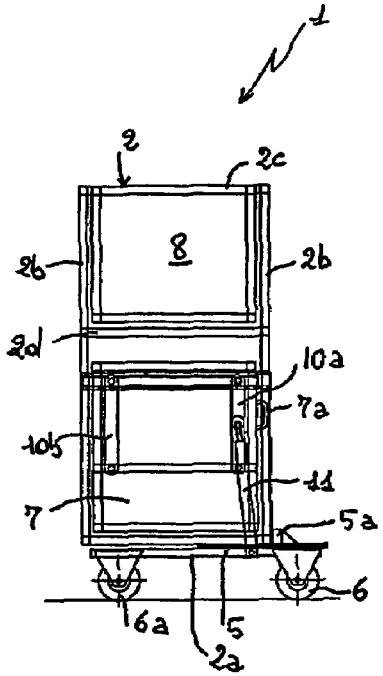
FIG. 5 shows in lateral view a variation of the mobile unit according to the present invention in closed mode.

The mobile unit illustrated above is designed to change from a rest mode in which it is closed, that is with the warehouse case 7 placed inside structure 2 and with the large warehouse case 8 placed above and parallel to the previous one, as shown in FIG. 2, to an operative mode in which the warehouse case 7 is outside structure 2 and placed next to the large warehouse case 8, as shown in FIG. 4.

To pass from the rest mode to the operative one, the user of the mobile unit simply has to lightly slide the large warehouse case 8 towards the outside from the rear part of the mobile unit, then extracts the warehouse case 7 sliding it on the lateral guides 5 and follows it through in its ascent which is carried out by the actuating means 11, as shown in FIG. 3.

In greater detail, the large warehouse case 8 is moved to create enough space for the warehouse case 7 to be able to move upwards in its rotation from the rest position to that in which the two warehouse cases are positioned side by side. Besides, when the warehouse case 7 is extracted, the lateral guides 5 come out of the base frame 2*a* also moving the two stabilizing wheels 6 so that the mobile unit is stable and does not run the risk of tipping over from the weight of the objects present in the lower warehouse case.

In greater detail, when the lower warehouse case is moved towards the outside it meets a pair of matching means 5*a* placed on the base frame 2*a* which allow the frame itself to move telescopically and to widen. At this point, the large warehouse case 7 rises again on the action of the actuating means that make each pair of connecting rods 10 rotate, so that they pass from a vertical rest position to a horizontal one when they are operative, as shown in FIG. 4.

In accordance with the present invention and as shown in FIGS. 5 to 8, a different form of embodiment of the mobile unit in question presents the structure 2 with a base frame 2*a* from which vertical uprights 2*b* are detached which engage a second frame 2*c* and between the base frame 2*a* and the second frame 2*c* a third frame 2*d* is present. On the base frame 2*a*, a pair of linear guides 5 is mounted which make the base frame telescopic. Similarly to the previous mobile unit, the structure is equipped with a pair of stabilizing wheels 6 and two other wheels 6*a*.

Figure 8:
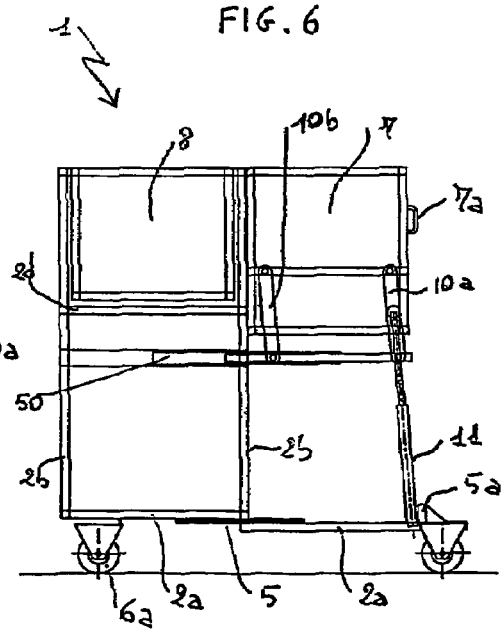
FIG. 8 shows the mobile unit from FIG. 5 in operative mode.

The structure 2 of the mobile unit in question foresees the presence of a pair of lateral guides 50 essentially positioned slightly underneath the third frame 2*d* and designed to slide the lower warehouse case 7 towards the outside of the front part until doubling the depth. The lower warehouse case 7 is designed to rise up until reaching the level of a upper warehouse case 8 as shown in FIG. 8. The warehouse case 7 rises manually or with the help of actuating means 11 through two pairs of levers 10 placed laterally.

In particular, levers 10*a* and 10*b* of each pair of levers 10 are placed parallel to each other and respectively present a revolving end engaged to the lateral guides 50 and the other end is attached to the warehouse case 7 at a predetermined point. As shown in FIGS. 5, 6, 7 and 8, each pair of levers 10 is designed to change from a rest position, in which the levers are shown to be vertical (FIG. 5), to an operative position in which they are rotated by more than 180° until nearly 190° (FIG. 8).

Moreover, the warehouse case 7 is equipped with a handle 7*a* for easy grip and movement of the case itself.

The mobile unit in question, as anticipated, is equipped with actuating means 11 that help the movement of the warehouse case 7 both in opening and closing phases to considerably limit the effort that the street trader has to carry out when the warehouse case is full and can easily reach a weight of 40-50 kg.

Figure 7:
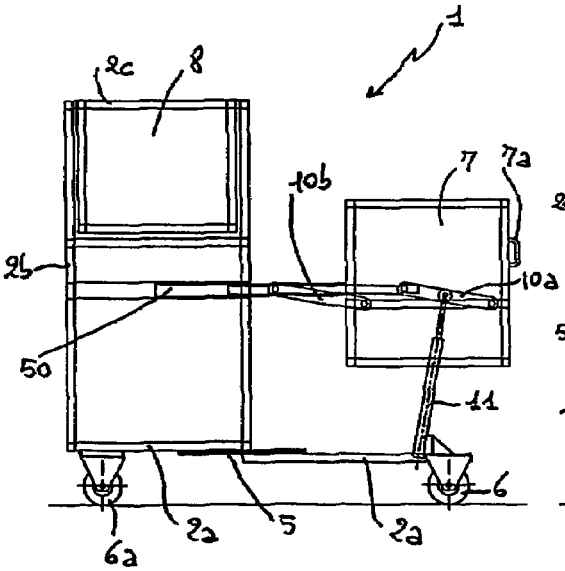

The actuating means are allocated on the base frame 2*a* in the telescopic portion as clearly shown in FIGS. 7 and 8. In accordance with the present embodiment, mobile unit 1 is equipped with a warehouse drawer (not illustrated in the figures) placed beneath the two warehouse cases 7 and 8 illustrated previously when the latter have a height smaller than that which is illustrated which allows a residual space to house the warehouse drawer underneath.

The mobile unit illustrated here is designed to change from a rest mode in which it is closed (FIG. 5) to an operative mode in which the warehouse case 7 is placed externally to structure 2 and next to the large warehouse case 8 (FIG. 8).

Figure 6:
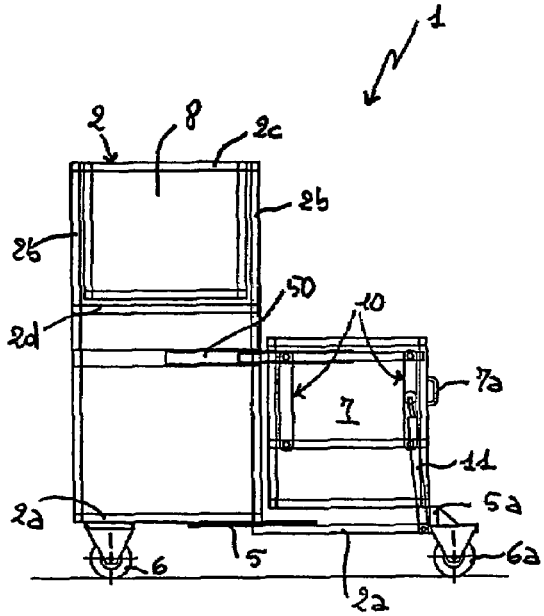
FIGS. 6 and 7 show the mobile unit from FIG. 5 in two different positions during opening.

To pass from the rest mode to the operative one, the street trader simply has to slide the warehouse case 7 on the linear guides 50 extracting it and widening the base frame so that the mobile unit is made stable and follow the case through in its ascent carried out by the actuating means 11, as shown in FIG. 6.

During the movement of the warehouse case 7, each pair of levers 10 carries out a rotation passing from the vertical position to a rotated position of over approximately 180° as shown in FIGS. 7 and 8.

Another form of embodiment of the mobile display unit in question concerns a refrigerated mobile unit for the transport and conservation of foodstuffs which require temperatures near to zero, as shown in FIGS. 9 to 13.

In this form of embodiment, structure 2 includes a base frame 2*a* which makes up the perimeter of a base surface from which four irremovable vertical uprights 2*b* are detached, on the upper end of which a second frame 2*c* is engaged which is provided to form the perimeter of a first display surface. Besides, structure 2 is provided with four movable uprights 2*e* which are rotatably engaged, at one of their ends, to a third frame 2*d* which forms the perimeter of a second display surface.

In accordance with the present invention, the third frame 2*d* presents at least two support elements 2*f* capable of forming a ground support to the frame itself when the mobile unit is in the open position to avoid tipping over.

According to this form of embodiment, structure 2 is produced by means of a plurality of sections in anodized aluminium or stainless steel preferably having quadrangular elements joined together by means of joints in molten aluminium.

In particular, the first display surface is composed of a first sliding container 15 on guides 150 with a parallelepiped configuration in which one side is open, as the internal edge is missing, and the covering surface is partial and corresponds to little more than half of the entire surface and forms a work surface 15*a* for the street trader.

Similarly, the second display surface is composed of a second sliding container 16 on guides 160 with a parallelepiped configuration in which one side is open, as the internal edge is missing, and the covering surface being absent.

In greater detail, the first and second containers do not have an internal edge, so that a single surface can be obtained once the mobile unit is in operative mode, that is to say with the two display surfaces placed side by side creating a single surface.

Moreover, the first 15 and the second 16 containers are produced in metal and all the walls are insulated to maintain the temperature inside the display surface. As an alternative to metal, containers 15 and 16 are produced in fibreglass covered with gelcoat suitable for foodstuffs, to reduce the overall weight of the mobile unit.

In particular, the first and second containers have, each on the prearranged side to make contact with the corresponding one, an isolation element 17 formed by a gasket to avoid cold loss and the forming of condensation. To attach the edges to each other there are coupling devices 18 formed by a ring 18*a* on one side which attaches to a hook 18*b* placed on the other edge.

Figure 12:
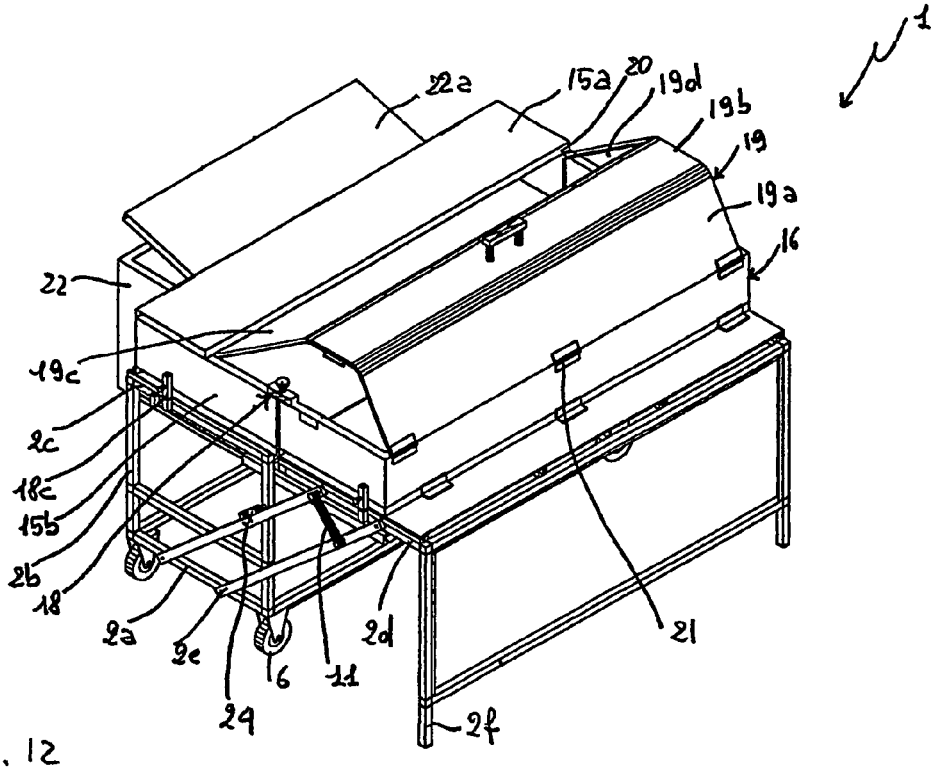
FIG. 12 shows in perspective view the mobile unit from FIG. 10 in the open position.
Figure 11:
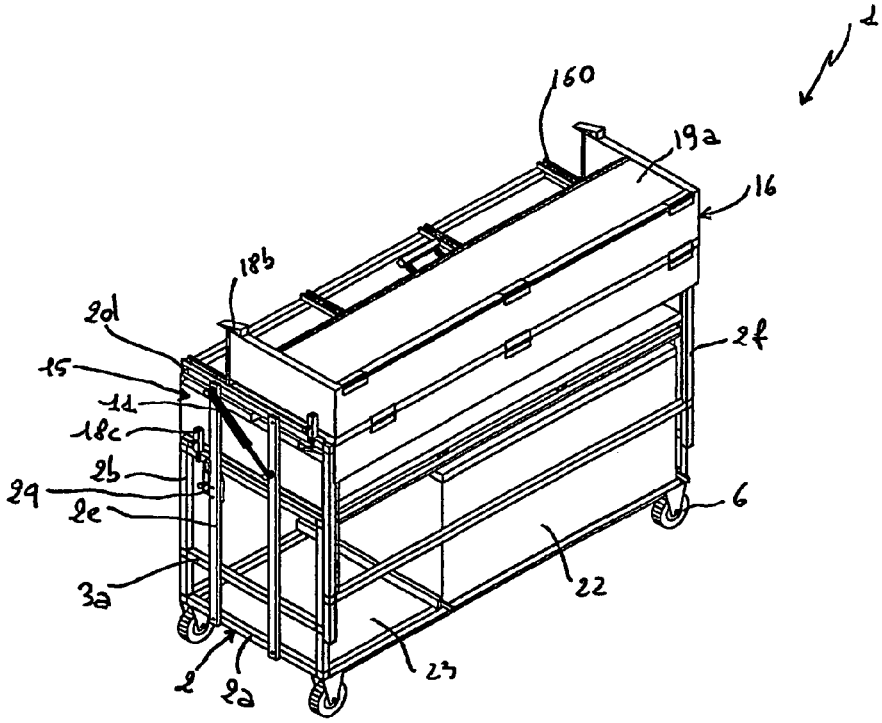
FIG. 11 shows in rear perspective view the mobile unit from FIG. 9 in closed mode.

As highlighted in FIG. 12, the said mobile unit, to cover the display surface, has a cover 19 in transparent material i.e. lexan or plexiglass with an essentially trapezoidal configuration composed of a first portion 19*a* that engages to the external edge 16*a* of the second container 16 and a second rectangular portion 19*b* which detaches from the first portion and that is parallel to the bottom surface of the second container. The cover 19 also includes a third covering portion 19*c* that closes the display surface and is attached on one side to the work surface 15*a* and on the other to the second portion 19*b*. The third portion 19*c* is composed of two sliding doors on guides 20 that are used by the street trader to access the display surface. Finally, the cover 19 includes a pair of lateral portions 19*d* provided to laterally close the cover 19.

In greater detail, the lateral edges 15*b* and 16*b* of the first and second containers are equipped, at the top, with a U-guide 20*a* and 20*b* respectively to accommodate the lateral covering portion 19*d*. Besides, the external edge 16*a* of the second container presents a plurality of hinges 21 to engage the first portion 19*a* to the edge itself.

In accordance with the present embodiment, but different to that previously described, the second container 16 has a lower external edge 16*a* with respect to the height of the lateral edges and the first covering portion 19*a* has an additional portion which closes the missing part of the edge.

The mobile display unit provides for the presence of a large warehouse case 22 which is also refrigerated, allocated on the base frame 2*a* and designed to slide on guides to be easily extracted. The large warehouse case 22 is provided with a lid 22*a*.

Besides, on the base frame 2*a* there is a second large warehouse case to store various types of objects, packaging and other items that the street trader may need or alternatively there is an empty space 23, again to store objects or equipment. In accordance with the present embodiment, the refrigeration inside the display surface and the large warehouse case is obtained by means of at least two refrigerating elements substantially known in the art. The refrigerating elements used are kept in a refrigerated environment for 15-16 hours and one is then inserted into the large warehouse case and at least one but preferably two into the display surface.

Moreover, the refrigeration can also be carried out by means of a traditional refrigerating system, either electrical or gas operated.

In accordance with the present invention, the mobile unit is provided with a pair of actuating means 11 each of which has one end engaged on a movable upright 2*e* in correspondence with the third frame 2*d* and the other end on the other movable upright almost in correspondence with the second frame 2*c*.

Besides, structure 2 is equipped with stopping devices 18*c* to block the sliding of containers 15 and 16 both in closed and open modes. Finally, structure 2 is provided with a blocking ratchet 24 designed to hold the second container in the rest position.

Figure 10:
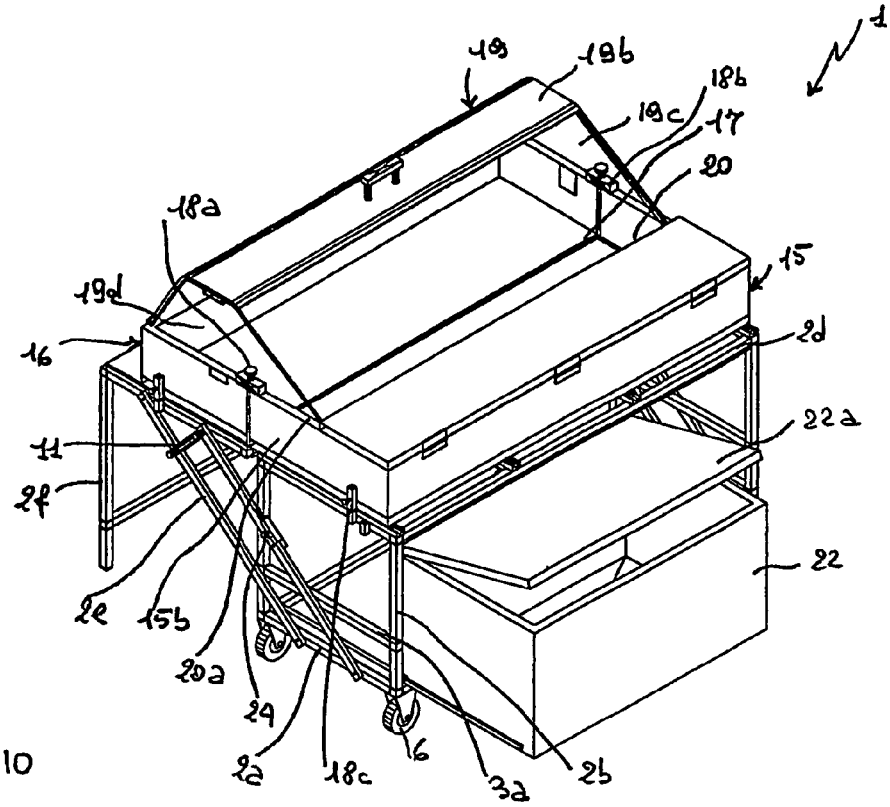
FIG. 10 shows in front perspective view the mobile unit from FIG. 9 in the open position.
Figure 9:
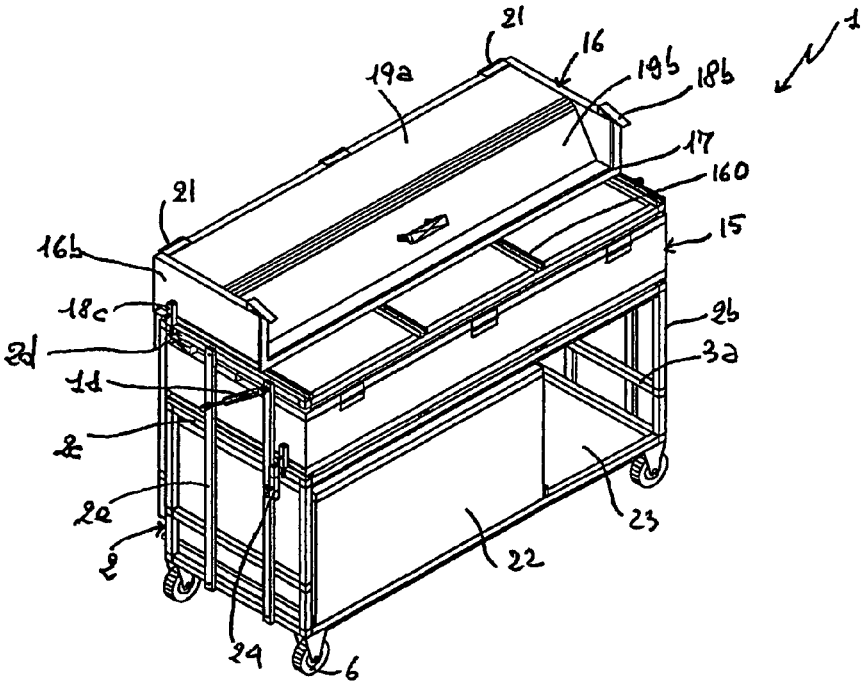
FIG. 9 shows in front perspective view another mobile unit in question in closed mode.

Naturally, also this mobile unit is equipped with wheels 6 capable of facilitating the movements of the mobile unit itself. The refrigerated mobile unit, illustrated here, is also designed to change from a rest mode where it is closed that is, with the second container placed above the first and the movable uprights 2*e* in a vertical position, as shown in FIG. 9, to an operative mode in which the first and second containers are placed side by side forming a single and containing display surface, as shown in FIG. 10.

To pass from the rest mode to the operative one, the user of the mobile unit simply has to slide the first container 15 towards the outside from the rear part of the mobile unit, then rotate the second container 16 by approximately 90° and, while it is turning, the second container descends until reaching the height of the first container. To obtain such a movement it is sufficient to manually follow through the rotation of the movable uprights until the two support elements 2*f* are touching the ground and such a movement is aided by the actuating means 11 so that the operator's effort is almost completely eliminated.

Figure 13:
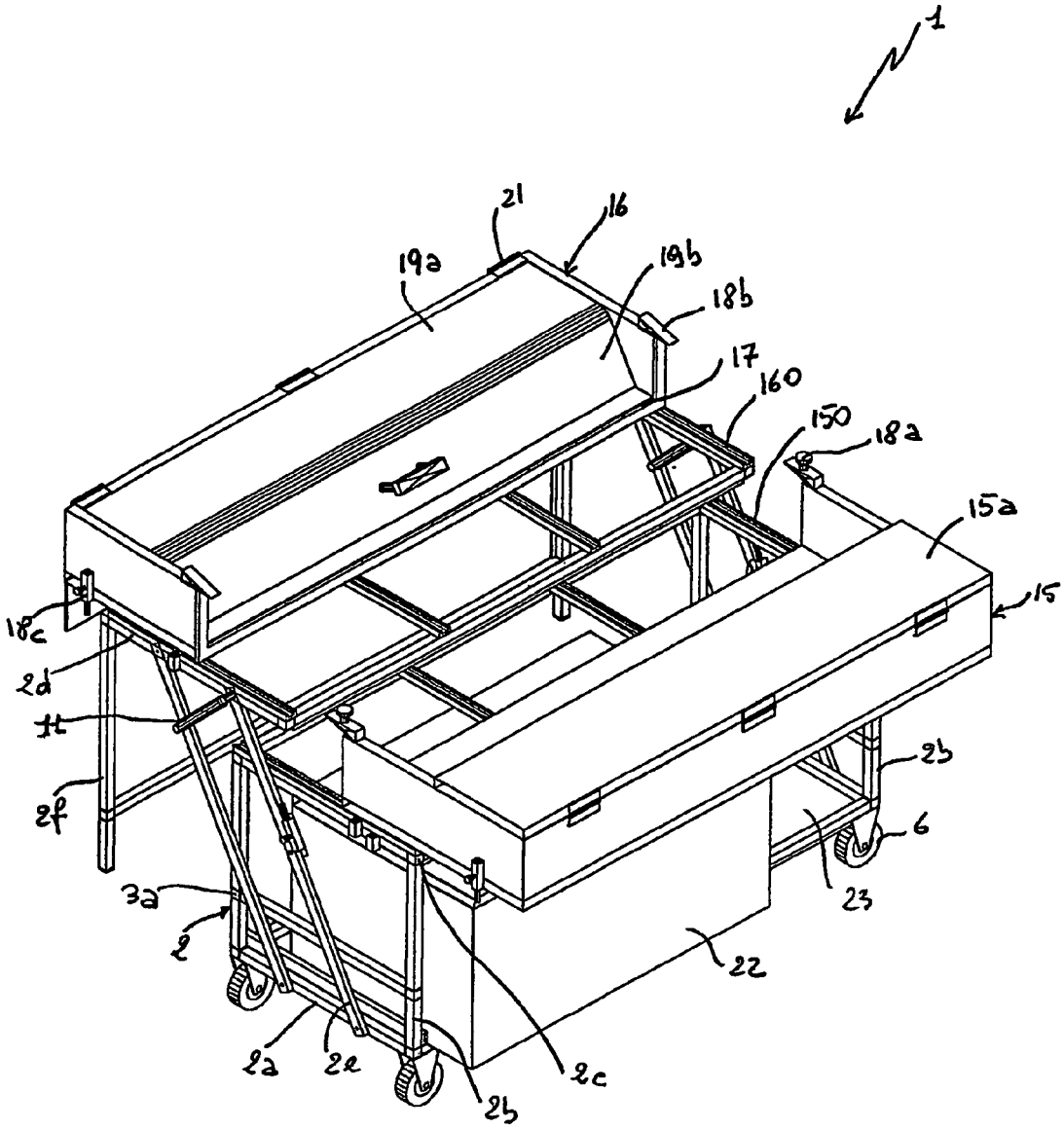
FIG. 13 shows the mobile unit from FIG. 9 in the semi-open position.

In greater detail, the first container 15 is moved in order to create enough space for the second container 16 to be able to move towards the outside and downwards in its rotation from the rest position to that in which the two containers end up on the same level. When the two containers are at the same level, to obtain a single display surface, the operator simply has to slide the two containers towards each other to bring them into mutual contact interlocking the isolating elements 17 and closing the coupling devices 18, as well as operating the stopping devices 18*c* designed to prevent the sliding of the containers and maintain them in the planned position to obtain a single container. Once the display surface is set up, the operator simply has to insert the two lateral portions 19*d* which form the lateral walls of the cover 19 into the U-guides 20*a* and 20*b* and rotate the first 19*a* and the second 19*b* portions of the cover until making contact with the lateral portions, and insert the two sliding doors 19*c*. In detail, revolving portions 19*a* and 19*b* are rotatably attached to the external edge of the second container and, once assembled, when the street trader has to put the mobile unit into the closed position, it is sufficient, after having removed the lateral portions, to rotate the portions 19*a* and 19*b* towards the inside of the container, thus creating a cover for the stored foodstuffs, as shown in FIG. 13.

Figure 15:
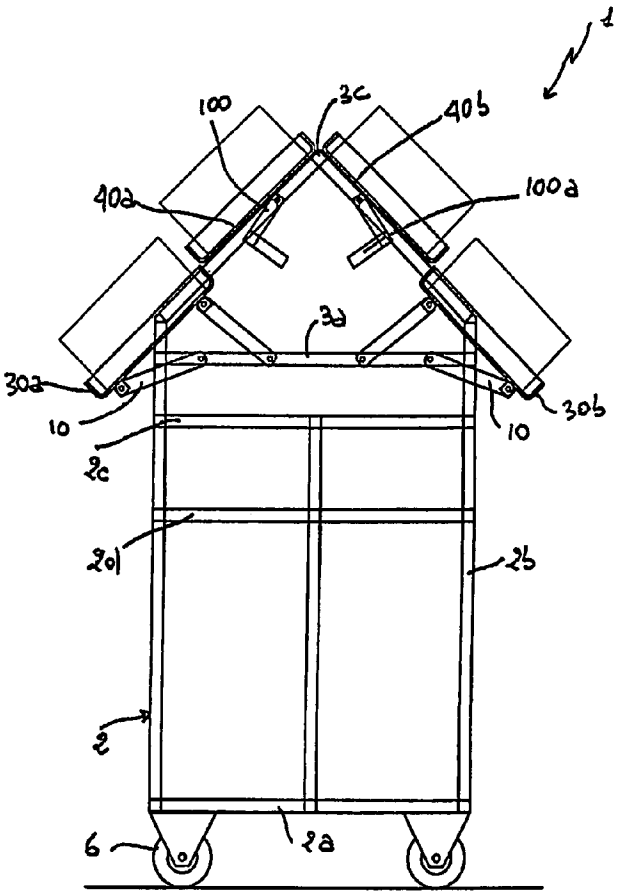
FIG. 15 shows in lateral view the mobile unit from FIG. 14 in operative mode.
Figure 19:
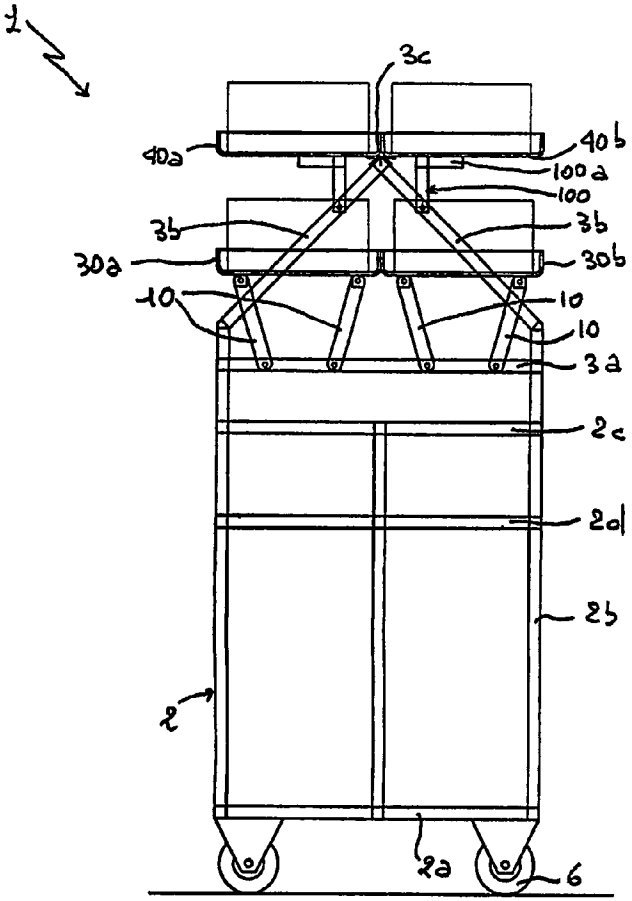

Another way of producing the mobile display unit according to the present invention is particularly recommended for the display of shoes as clearly illustrated in FIGS. 14 and 15.

Mobile unit 1 is also composed of the structure 2, produced in sections of aluminium or stainless steel and essentially composed of a base frame 2*a* from which a plurality of irremovable and vertically placed uprights 2*b* are detached. Near to the upper end of the uprights 2*b*, a second frame 2*c* is engaged which forms the upper surface of the mobile unit 1.

Besides, structure 2 has a third frame 2*d* placed below at a prearranged distance from the second frame 2*c*. In particular, the second frame 2*c* is conceived to accommodate a first pair of extractable display surfaces, designed to come out of the structure laterally while the third frame 2*d* is designed to accommodate a second pair of display surfaces envisaged to exit the structure of the mobile unit, one from the front and the other from the rear part.

Structure 2 also presents a first pair of horizontal struts 3*a* placed above, at a prearranged distance from the second frame 2*c* and parallel to the frame itself and a second pair of horizontal struts 3*b* placed above the first pair and placed in such a way that they form an essentially triangular element with the horizontal strut 3*a*, as shown in FIG. 14.

The mobile unit in question also includes a plurality of display surfaces (30*a*, 30*b*, 40*a* and 40*b*). In greater detail, the first surfaces 30*a* and 30*b* are respectively allocated, one on the front part of the mobile unit and the other on the rear part and they are placed symmetrically to each other with respect to the longitudinal centre line of the mobile unit. The first surface 30*a* is attached to structure 2 by means of a pair of levers 10 in which each lever presents an end that is rotatably attached to the horizontal strut 3*a* and the other end to the surface at a predetermined point. The ends of the pair of levers are mounted on the surface and are slightly open with respect to those engaged to the horizontal strut 3*a*. Similarly, for surface 30*b*.

The second surfaces 40*a* and 40*b* are respectively allocated, one in the front part of the mobile unit and the other in the rear part and these are also placed symmetrically to each other with respect to the longitudinal centre line of the mobile unit. The second surface 40*a* is attached to structure 2 by means of a pair of angular elements 100 in which each element has an end which is rotatably attached to the horizontal strut 3*b* and the other end attached to the relative support portion 100*a* under the second surface 40*a* when it is in the closed position, as shown in FIG. 14. Besides, the second surface 40*a* is rotatably attached to a longitudinal horizontal strut 3*c* that connects the two horizontal struts 3*b*. Similarly, for the second surface 40*b*.

Moreover, surfaces 30*a*, 30*b*, 40*a* and 40*b* have perpendicularly folded edges to avoid the shoes sliding when the mobile unit is in operative mode. Besides, all the surfaces are produced in transparent material i.e. lexan or plexiglass. Naturally, also this mobile unit is equipped with wheels 6 for easy movement.

The mobile unit is also designed to change from a rest mode in which it is closed, as shown in FIG. 14, and the first surfaces 30*a* and 30*b* are parallel to the base frame 2*a* and reciprocally positioned side by side and bound by a stopping element which engages the two surfaces to each other while the second surfaces 40*a* and 40*b* are also placed side by side and placed above and parallel respectively to the surfaces 30*a* and 30*b*, to an operative mode where the surfaces 30*a*, 30*b*, 40*a* and 40*b* turn out to be sloped like the horizontal strut 3*b*, as shown in FIG. 15, and the other display surfaces come out laterally, at the front and at the back.

To pass from the rest mode to the operative one, the street trader simply has to rotate the surfaces 30*a* and 30*b* towards the outside of the mobile unit which will take up the operative position following the rotation carried out by the levers 10, and then rotate the surfaces 40*a* and 40*b* so that the angular element 100 turns and falls down letting the surface attached to the horizontal strut 3*c* rotate, as in FIG. 15. At this point, the operator simply has to extract the lateral display surfaces placed on the frame 2*c* and those at the front and rear placed on the third frame 2*d*. The base frame 2*a* is used to store all the boxes of the displayed shoes.

After this predominantly structural description, there will now follow a description of the functioning of the unit in question.

When a street trader uses the mobile unit at the place of sale he simply has to, after unloading the mobile unit from the lorry used for its transport by means of two guides which allow him to lower the mobile unit easily to the ground, take it from the rest mode to the operative one and start the sale of the products. Similarly, at the end of the working day, the street trader simply has to repeat the operations previously described replacing the mobile unit in the closed position and reload it onto the lorry.

The present invention in this way achieves the proposed aims. In fact the mobile display units illustrated have a structure with contained dimensions which can easily be loaded not only onto a lorry or van as is commonly done by Italian street traders but can also be loaded into vehicles such as station wagons or other smaller vehicles as is customary in foreign countries.

Besides, the mobile unit allows the operator to place it in the operative mode without exerting physical effort, to lift it during opening or lower it during closing or vice versa.

The refrigerated mobile display unit in question is capable of functioning autonomously without the need for connections to electricity supply and without the presence of dangerous gas cylinders. Besides, the mobile unit allows considerable cost limitation from the time when it is no longer necessary to prepare a special van as in the past. In addition, with the refrigerated mobile unit it has been found that the relationship with the public is greatly improved as the sales are carried out with the street trader and the public at the same level and no longer from above from a van, with consequent improvement in human relations which are translated into greater sales, also due to the fact that the consumer has the possibility of viewing the products on sale which is not always possible with vans.

Advantageously, the shoe carrying mobile unit allows considerable display of shoes which always remains ready without the need to replace them every time as currently happens and without the unattractive presence of all the boxes, at times stacked up untidily due to the little time that is available during display preparation.

In addition, the mobile units according to the present invention allow easy use and good manoeuvrability as well as ease of set up.

A further advantage brought about by the invention in question derives from the fact that the mobile units have a practical and fast opening and closing. Another advantage is due to the fact that the mobile display units in question have proven to be simple to produce with good functionality.

Naturally, numerous modifications and variations can be brought about to the present invention, which all fall into the scope of the inventive concept that characterizes it.

The invention claimed is:

1. Mobile display unit for street traders including a structure (2), produced in sections of aluminium or stainless steel with joints in molten aluminium and comprising a telescopic base frame (2*a*) with linear guides (5), a plurality of uprights (2*b*) extending from the frame (2*a*), a second top frame (2*c*), a first pair of horizontal struts (3*a*), a second pair of horizontal struts (3*b*) and a third frame (2*d*) placed between the two pairs of horizontal struts, characterized in that:

said base frame comprises a fixed portion and a telescopic portion, said linear guides (5) accommodating at least one large warehouse case (7) while the structure (2) is equipped with at least one second large warehouse case (8) placed above the large warehouse case (7) and able to slide on guides (9) that are attached to the third frame (2*d*), the structure (2) including on each side, a pair of connecting rods (10) provided for the movement of the large warehouse case (7), each pair of connecting rods (10) assisted by at least one actuating means (11), the said mobile unit is designed to change from a rest mode where it is closed with the large warehouse case (7) placed inside the structure (2) and with the second large warehouse case (8) placed above and parallel, to an operative mode where the large warehouse case (7) ends up outside the structure (2) and next to the second large warehouse case (8).

2. Mobile display unit according to claim 1, characterized by the fact that each pair of connecting rods (10), provided for the movement of the large warehouse case (7), has a first connecting rod (10*a*) attached, with one end, to the second frame (2*c*) and, with the other, to the upper edge of the large warehouse case (7) and a second connecting rod (10*b*) attached respectively with one end to the second horizontal strut (3*b*) and with the other end to a prearranged point on the lateral wall of the large warehouse case (7), said pair of connecting rods being designed to carry out a rotation so that they pass from a vertical rest position to a horizontal one when operative.

3. Mobile display unit according to claim 1, characterized by the fact that one of said connecting rods in each of said pair of connecting rods (10) (10*b*), essentially in correspondence with the centre line of the same, is engaged with one end of the actuating means (11) the other end of which is fixed to the first horizontal strut (3*a*).

4. Mobile display unit according to claim 3, characterized by the fact that said actuating means (11) comprises gas springs or electrical, pneumatic or hydraulic actuators.

5. Mobile display unit according to claim 1, characterized by the fact that two stabilizing wheels (6) are attached to the frame (2*a*), in the telescopic portion, while two other wheels (6*a*) are connected to the frame in the fixed portion.

6. Mobile display unit according to claim 1, characterized by the fact that on the base frame (2*a*) there is a pair of matching means (5*a*) that allow the frame itself to move when the large warehouse case (7) is moved.

* * * * *